US005904192A

United States Patent [19]

Chen

[11] Patent Number: 5,904,192

[45] Date of Patent: May 18, 1999

[54] WOOD PLANING MACHINE

[76] Inventor: Chin-Te Chen, No. 85, Lane 22, Han-Hsi St., Tung Dist., Taichung City, Taiwan

[21] Appl. No.: 09/139,278

[22] Filed: Aug. 25, 1998

[51] Int. Cl.[6] ..... B27C 1/02

[52] U.S. Cl. ..... 144/117.1; 144/114.1; 144/130; 144/246.1; 226/188; 226/194

[58] Field of Search ..... 144/114.1, 116, 144/117.1, 130, 245.1, 246.1, 248.6, 117.4, 248.4; 226/188, 194

[56] References Cited

U.S. PATENT DOCUMENTS

| | | | |
|---|---|---|---|
| 3,913,642 | 10/1975 | Porter | 144/117.1 |
| 4,422,486 | 12/1983 | Maret | 144/117.1 |
| 4,483,378 | 11/1984 | Chang et al. | 144/246.1 |
| 4,886,099 | 12/1989 | Ferreira de Abreu | 144/117.1 |
| 5,176,190 | 1/1993 | Miyamoto et al. | 144/117.1 |
| 5,799,854 | 9/1998 | Lin | 226/188 |
| 5,829,499 | 11/1998 | Liao | 144/130 |

*Primary Examiner*—W. Donald Bray
*Attorney, Agent, or Firm*—Finnegan, Henderson, Farabow, Garrett & Dunner, L.L.P.

[57] ABSTRACT

A wood planing machine includes a working table, and a carrier body that is disposed above and movable relative to the working table in order to adjust the depth of cut. The carrier body is further provided with a gear mechanism disposed at one side thereof such that the gear mechanism does not extend beyond the lowermost portion of the carrier body.

1 Claim, 6 Drawing Sheets

WOOD PLANING MACHINE

BACKGROUND OF THE INVENTION

1. Field of the Invention

The present invention relates to a wood planing machine, more particularly to one which includes a working table and a carrier body disposed above the working table. The carrier body is provided with a cutter head and a speed reduction gear mechanism disposed at one side thereof in such a manner as not to extend beyond the lowermost part of the carrier body.

2. Description of the Related Art

Referring to FIGS. 1 and 2, a conventional wood planing machine is shown to include a working table 40, left and right pairs of upright mounting posts 11, 14, a carrier body 20, an electric motor 30, a drive shaft 21, a first transmission belt 32, a speed reduction gear mechanism 22, and infeed and outfeed shafts 26, 24.

As illustrated, the working table 40 includes left and right mounting sides 40M spaced apart from each other in a transverse direction, and infeed and outfeed sides 40F, 40T disposed apart from each other to form a planing path in a longitudinal direction. The left and right mounting posts 11, 14 are disposed uprightly on the left and right mounting sides 40M of the working table 40.

The carrier body 20 is disposed above the working table 40, and includes upper and lower mounting walls 201, 202, left and right mounting walls 203, 204 that are spaced apart from each other in the transverse direction, and a cutter head (not visible) journalled on the left and right mounting walls 203, 204 along the transverse direction. The upper, lower, left and right mounting walls 201, 202, 203, 204 cooperatively define an accommodating chamber 205 therein. The carrier body 20 further includes two pairs of guiding members (not visible) that are disposed proximate to the left and right walls 203, 204, respectively, and are slidable on the posts 11, 14 so as to permit adjustment of the depth of cut between the lower mounting wall 202 and the working table 40. The motor 30 is disposed above and secured relative to upper mounting wall 201, and has an output shaft 31 oriented in the transverse direction. The output shaft 31 extends beyond the left mounting wall 203 of the carrier body 20. The drive shaft 21 is journalled on the left mounting wall 203 and extends into the accommodating chamber 205. The drive shaft 21 is adapted to rotate the cutter head (not visible). The first transmission belt 32 is trailed over the output shaft 31 and the drive shaft 21 in order to transmit rotation of the output shaft 31 to the drive shaft 21. Infeed and outfeed shafts 26, 24 are disposed in the accommodating chamber 205 along the transverse direction, and have two connecting ends that extend beyond and outwardly of the right mounting wall 204, as best shown in FIG. 3. The speed reduction gear mechanism 22 is mounted on the right mounting wall 204 and operably connected to the drive shaft 21 in the accommodating chamber 205 so as to reduce the rotation speed thereof. The gear mechanism includes a driving shaft (not visible) operably connected with the drive shaft 21, and a driven shaft 221 that is journalled on and extends outwardly of the right mounting wall 204. A second transmission belt 23 is trailed over the connecting end of the outfeed shaft 24 and the driven shaft 221 so as to transmit rotation speed of the latter to the former. A third transmission belt 25 is trailed over the connecting end of the infeed shaft 26 and a transmitting wheel which is coaxially mounted on the connecting end of the outfeed shaft 24 so as to synchronize rotation speed of the infeed and outfeed shafts 24, 26.

In the aforesaid planing machine, the depth of cut is achieved by relative movement between the carrier body 20 and the working table 40. The gear mechanism 22 is disposed on the right mounting wall 204 at an elevation below the connecting ends of the infeed and outfeed shafts 24, 26. The right mounting side 40M of the working table 40 is formed with a lateral recess 41 in order to avoid collision between the gear mechanism 22 and the working table 40 during adjustment of the depth of cut. As a result, wood chips resulting from the wood planing operation thereof may fall into the recess 41. Removal of wood chips therefrom is laborious and may cause serious injury in the case of accidentally extending one's hands into the recess during the planing operation.

SUMMARY OF THE INVENTION

Therefore, the object of the present invention is to provide a wood planing machine which includes a working table and a carrier body that is disposed above the working table and provided with a speed reduction gear mechanism movable relative to the working table during adjustment of the depth of cut. The gear mechanism is disposed such that it does not extend beyond the lowermost part of the carrier body.

Accordingly, a wood planing machine of this invention includes a working table, a carrier body, an electric motor, a drive shaft, a first transmission belt, a speed reduction gear mechanism, a take-out shaft, a second transmission belt, a feed shaft, and a third transmission belt. The working table includes left and right mounting sides spaced apart from each other in a transverse direction, and feed-in and feed-out sides spaced apart from each other to form a planing path in a longitudinal direction. Left and right pairs of mounting posts are uprightly disposed on the left and right mounting sides, respectively, of the working table. The carrier body is disposed above the working table, and includes upper and lower major mounting walls, and left and right minor mounting walls spaced apart from each other in the transverse direction. The upper and lower major mounting walls and the left and right minor mounting walls cooperatively define an accommodation chamber therein. The carrier body further includes two pairs of upright guiding members disposed proximate to the left and right minor mounting walls, respectively. The guiding members are slidable on the mounting posts respectively so as to permit slidable adjustment of the relative position of the lower major mounting wall to the working table. The electric motor is disposed above and fixedly secured relative to the upper major mounting wall, and has an output shaft oriented in the transverse direction and extends beyond the left minor mounting wall. The drive shaft extends into the accommodation chamber in the transverse direction to rotate a cutter head that is rotatably mounted relative to the lower major mounting wall. The drive shaft has a first transmission end extending outwardly of and beyond the left minor mounting wall, and a first coupling end in the accommodation chamber and proximate to the right minor mounting wall. The first transmission belt is trailed over the output shaft and the first transmission end to transmit the driving force of the output shaft to rotate the first coupling end. The gear mechanism is disposed in the accommodation chamber, and has a driving shaft to be driven by the first coupling end, and a driven shaft that is journalled on and that extends outwardly of the right minor mounting wall in the transverse direction. The take-out shaft is journalled on the left and right minor mounting walls in the transverse direction and proximate to the take-out side. The take-out shaft is adapted to take a workpiece out of the planing path, and has a second transmission end extending outwardly of the right minor mounting wall, and a second coupling end that extends outwardly of the left minor mounting wall. The second transmission belt is trailed over the second transmission end and the driven shaft so as to transmit a lower drive speed of the driven shaft to rotate the take-out shaft as well as the second coupling end. The feed shaft is disposed in the accommodation chamber and extends in the transverse direction and proximate to the feed-in side. The feed shaft is adapted to feed the workpiece into the planing path. The feed shaft has a third transmission end that is journalled on and extends outwardly of the left minor mounting wall. The third transmission belt is trailed over the second coupling end and the third transmission end so as to synchronize rotation speed of the feed-in shaft with that of the take-out shaft.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
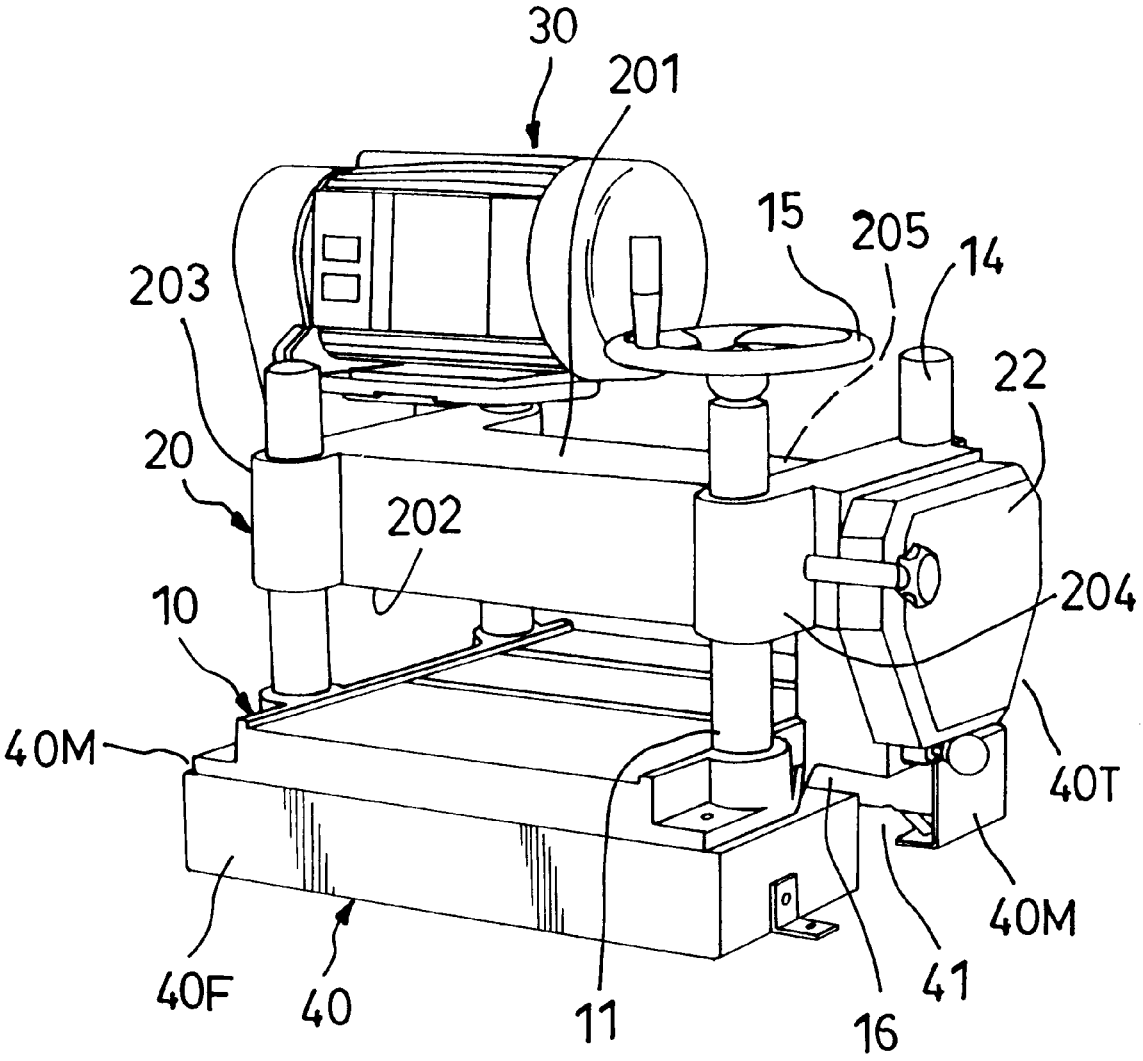
FIG.1 PRIOR ART
FIG. 1 is a perspective view of a conventional wood planing machine.
Figure 2:
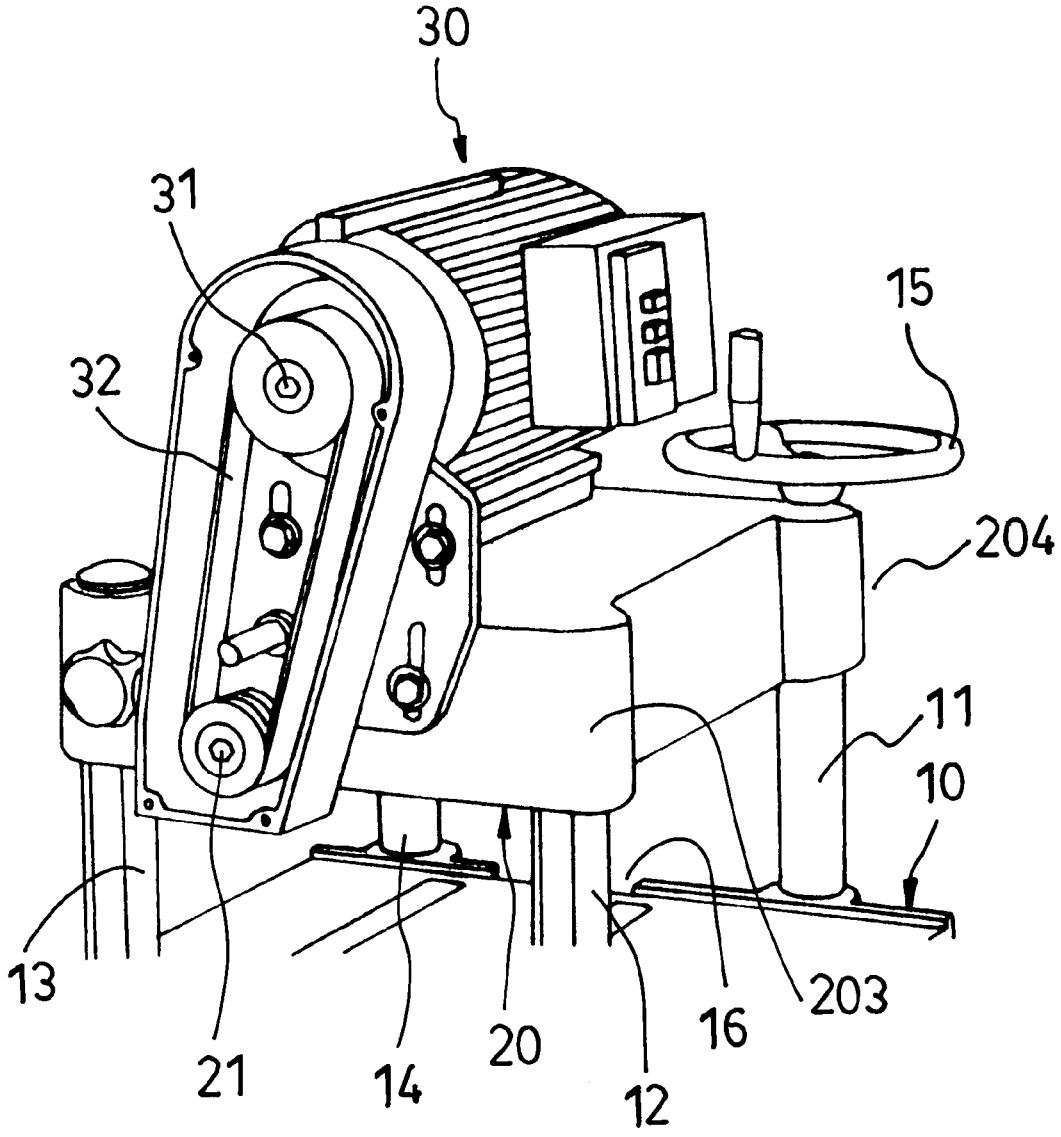
FIG.2 PRIOR ART
FIG. 2 is a partial left side view of the conventional wood planing machine.
Figure 3:
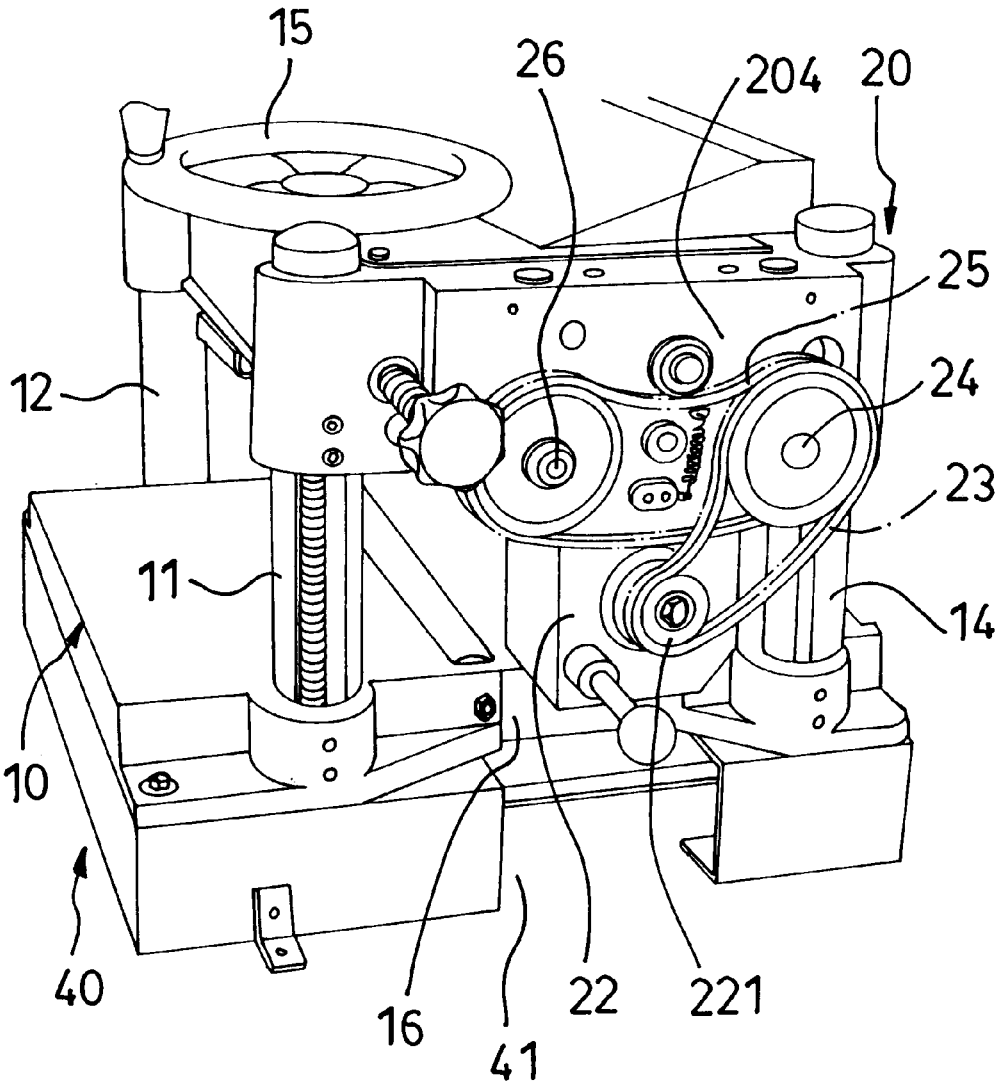
FIG. 3 PRIOR ART
FIG. 3 illustrates a partial right side view of the conventional wood planing machine.
Figure 4:
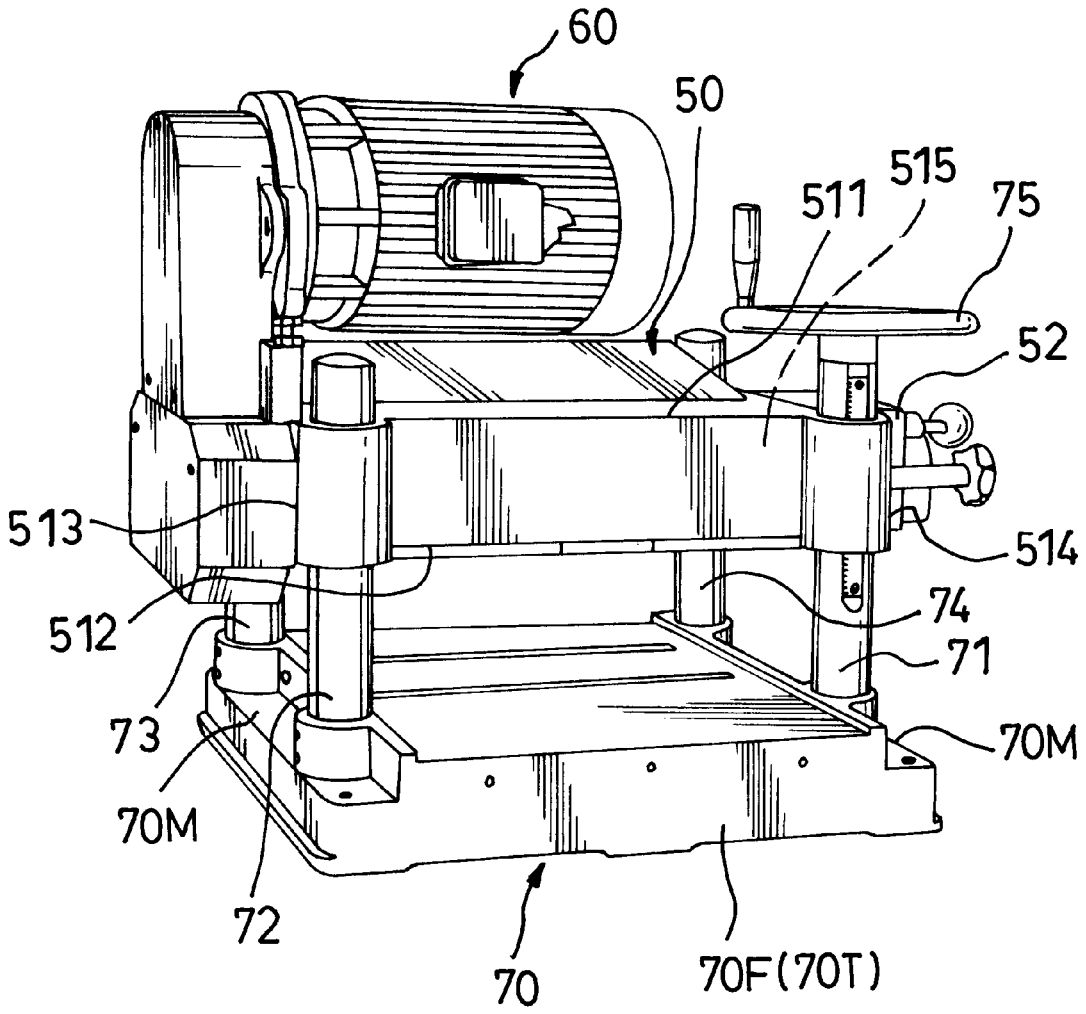
FIG. 4 shows a perspective view of a preferred embodiment of the wood planing machine of this invention.
Figure 5:
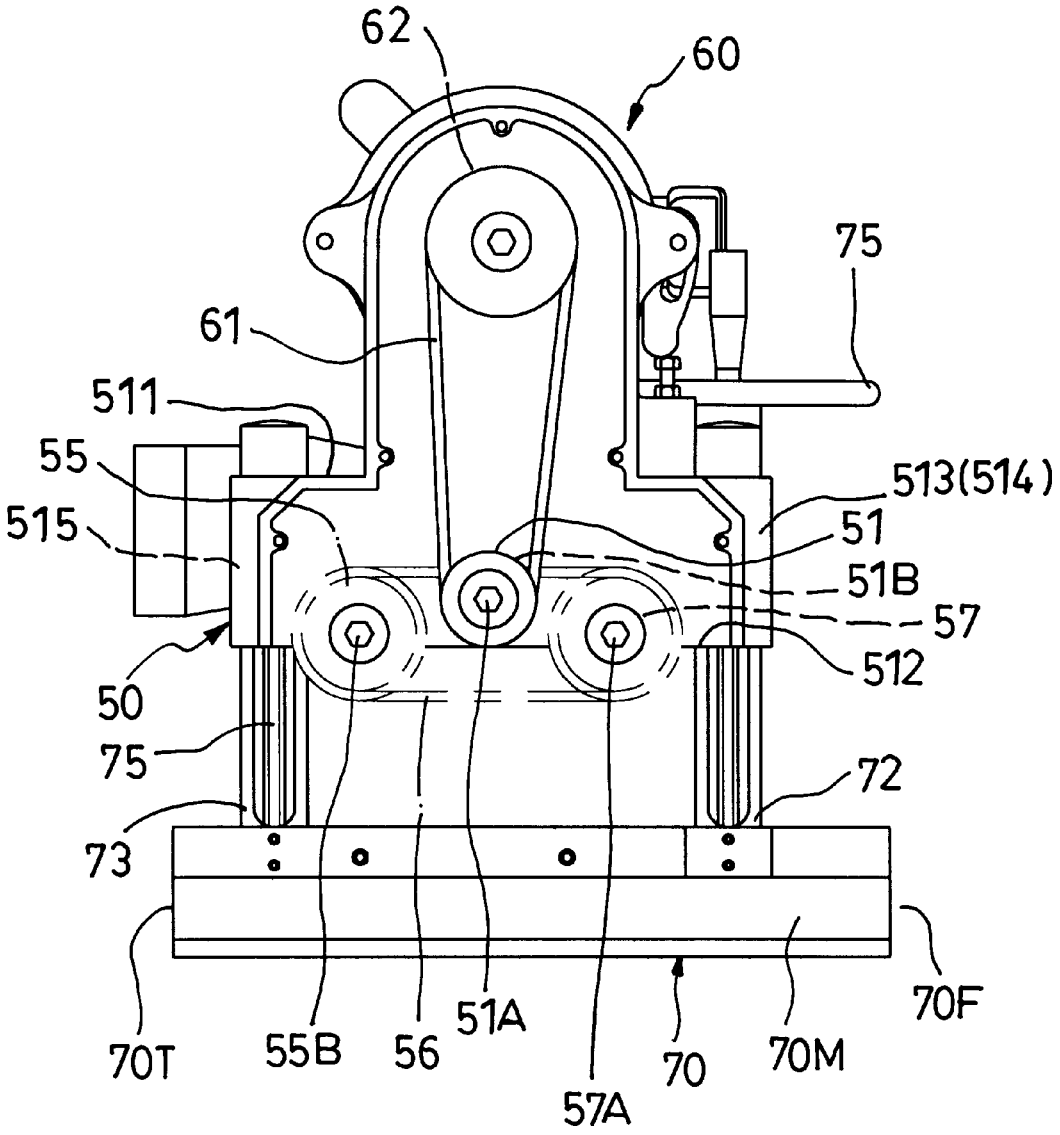
FIG. 5 is a left side view of the preferred embodiment.
Figure 6:
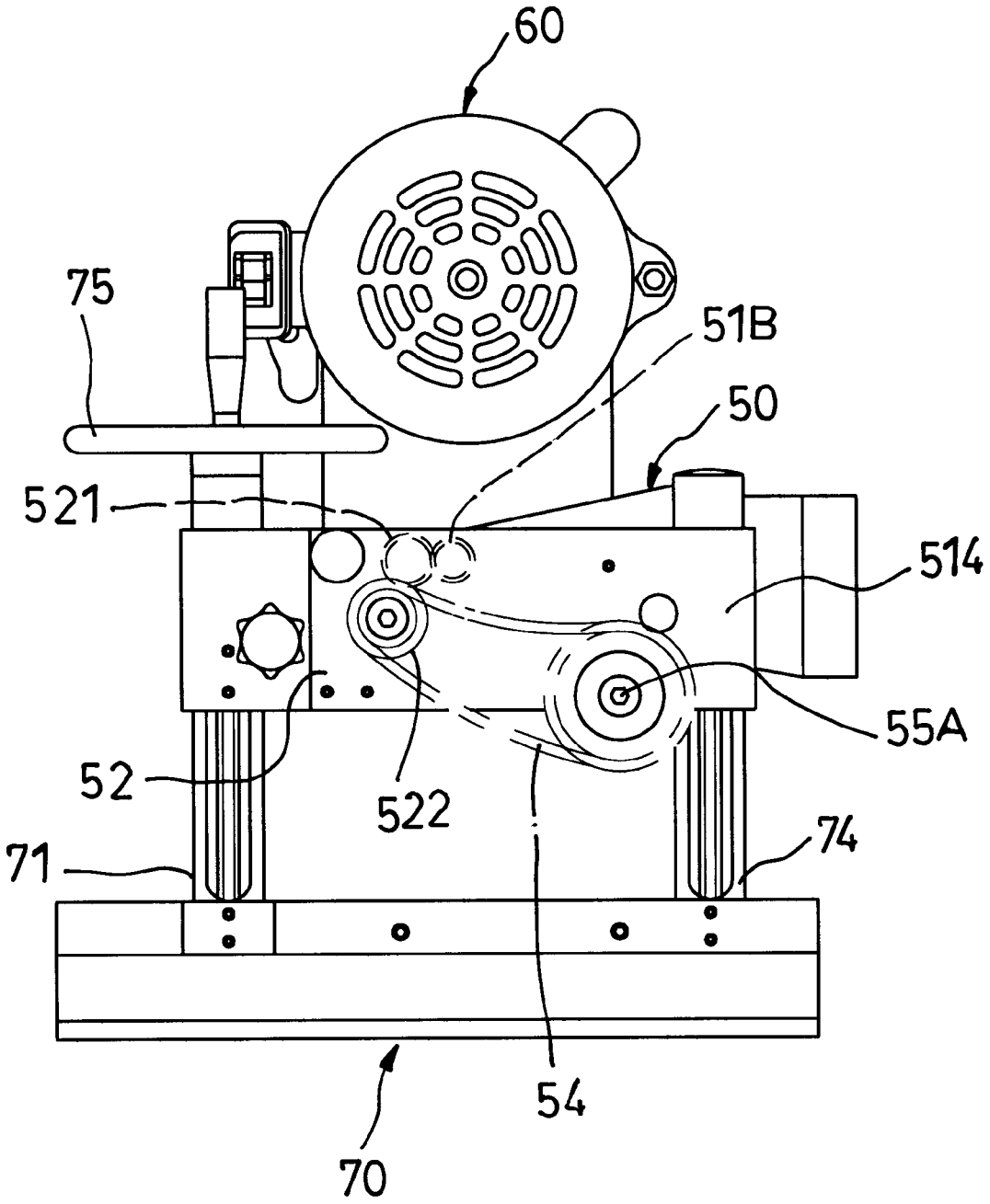
FIG. 6 is a right side view of the preferred embodiment.

Referring to FIGS. 4, 5 and 6, the preferred embodiment of a wood planing machine of this invention is shown to include a working table 70, a carrier body 50, an electric motor 60, a drive shaft 51, a first transmission belt 61, a speed reduction gear mechanism 52, a take-out shaft 55, a second transmission belt 54, a feed shaft 57, and a third transmission belt 56.

As illustrated, the working table 70 includes left and right mounting sides 70M spaced apart from each other in a transverse direction, and feed-in and feed-out sides 70F, 70T that are spaced apart from each other to form a planing path in a longitudinal direction.

Left and right pairs of mounting posts (71, 74), (73, 72) are mounted uprightly on the left and right mounting sides 70M of the working table 70, respectively.

The carrier body 50 is disposed above the working table 70, and includes upper and lower major mounting walls 511, 512, and left and right minor mounting walls 513, 514 spaced apart from each other in the transverse direction. The upper and lower major mounting walls 511, 512 and the left and right minor mounting walls 513, 514 cooperatively defines an accommodation chamber 515 therein. The carrier body 50 further includes two pairs of upright guiding members 75 disposed proximate to the left and right minor mounting walls 513, 514, respectively, and are slidably disposed on the mounting posts (73, 72), (71, 74) respectively so as to permit slidable adjustment of the relative position of the lower major mounting wall 512 to the working table 70.

The electric motor 60 is disposed above and fixedly secured relative to the upper major mounting wall 511. The motor 60 has an output shaft 62 oriented in the transverse direction and extending out of the left minor mounting wall 513.

The drive shaft 51 is journalled on the left minor mounting wall 513, and extends into the accommodation chamber 515 along the transverse direction. The drive shaft 51 is adapted to be connected with and rotate a cutter head that is rotatably mounted relative to the lower major mounting wall 512. The drive shaft 51 has a first transmission end 51A that extends outwardly of and beyond the left minor mounting wall 513, and a first coupling end 51B in the accommodation chamber 515 and proximate to the right minor mounting wall 514.

The first transmission belt 61 is trailed over the output shaft 62 and the first transmission end 51A to transmit the driving force of the output shaft 62 to rotate the first coupling end 51B.

The speed reduction gear mechanism 52 is disposed in the accommodation chamber 515, and includes a driving shaft 521 coupled with and driven by the first coupling end 51B, and a driven shaft 522 that is journalled on and extends outwardly of the right minor mounting wall 514 along the transverse direction.

The take-out shaft 55 is journalled on the left and right minor mounting walls 513, 514 in the transverse direction and proximate to said take-out side 70T, and is adapted to take a workpiece out of the planing path. The take-out shaft 55 has a second transmission end 55A that extends outwardly of the right minor mounting wall 514, and a second coupling end 55B that extends outwardly of the left minor mounting wall 513.

The second transmission belt 54 is trailed over the second transmission end 55A and the driven shaft 522 so as to transmit a lower drive speed of the driven shaft 522 to the take-out shaft 55 as well as the second coupling end 55B.

The feed shaft 57 is disposed in the accommodation chamber 515 of the carrier body and extends in the transverse direction and proximate to the feed-in side 70F. The feed shaft 57 is adapted to feed the workpiece into the planing path, and has a third transmission end 57A that is journalled on and extends outwardly of the left minor mounting wall 513.

The third transmission belt 56 is trailed over the second coupling end 55B and the third transmission end 57A so as to synchronize the rotation speed of the feed-in shaft 57 with that of the take-out shaft 55.

Note that since the gear mechanism 52 is disposed in such a way as not to extend beyond the lowermost portion of the carrier body 50, the gear mechanism 52 will not collide with the working table 70 during adjustment of the depth of cut. The object of this invention is thus achieved.

With this invention thus explained, it is apparent that numerous modifications and variations can be made without departing from the scope and spirit of this invention. It is therefore intended that this invention be limited only as indicated in the appended claims.

I claim:

1. A wood planing machine comprising:

a working table including left and right mounting sides spaced apart from each other in a transverse direction, and feed-in and feed-out sides disposed to be spaced apart from each other to form a planing path in a longitudinal direction;

left and right pairs of mounting posts uprightly disposed respectively on said left and right mounting sides, respectively;

a carrier body disposed above said working table, said carrier body including upper and lower major mounting walls, left and right minor mounting walls spaced apart from each other in said transverse direction, said upper and lower major mounting walls and said left and right minor mounting walls cooperatively defining an accommodation chamber therein, said carrier body further including two pairs of upright guiding members disposed respectively proximate to said left and right minor mounting walls, and slidable on said mounting posts respectively so as to permit slidable adjustment of relative position of said lower major mounting wall to said working table;

an electric motor disposed above and fixedly secured relative to said upper major mounting wall, said motor having an output shaft oriented in said transverse direction and extending beyond said left minor mounting wall;

a drive shaft journalled on said left minor mounting wall and extending into said accommodation chamber in said transverse direction and adapted to rotate a cutter head that is rotatably mounted relative to said lower major mounting wall, said drive shaft having a first transmission end extending outwardly of and beyond said left minor mounting wall, and a first coupling end in said accommodation chamber and proximate to said right minor mounting wall;

a first transmission belt trailed over said output shaft and said first transmission end to transmit the drive force of said output shaft to rotate said first coupling end;

a speed reduction gear mechanism disposed in said accommodation chamber, said gear mechanism having a driving shaft to be coupled with and driven by said first coupling end, and a driven shaft journalled on and extending outwardly of said right minor mounting wall in said transverse direction;

a take-out shaft journalled on said left and right minor mounting walls in said transverse direction and proximate to said take-out side, and adapted to take a workpiece out of the planing path, said take-out shaft having a second transmission end extending outwardly of said right minor mounting wall, and a second coupling end extending outwardly of said left minor mounting wall;

a second transmission belt trailed over said second transmission end and said driven shaft so as to transmit a lower drive speed of said driven shaft to rotate said take-out shaft as well as said second coupling end; and a feed shaft disposed in said accommodation chamber and extending in said transverse direction and proximate to said feed-in side, said feed shaft being adapted to feed the workpiece into said planing path, and having a third transmission end journalled on and extending outwardly of said left minor mounting wall; and a third transmission belt trailed over said second coupling end and said third transmission end so as to synchronize rotation speed of said feed-in shaft with that of said take-out shaft.

* * * * *